United States Patent [19]

Anderson et al.

[11] 4,196,554

[45] Apr. 8, 1980

[54] ROOF PANEL JOINT

[75] Inventors: John W. Anderson, Bradford Woods; Robert G. Lindner, Sewickley, both of Pa.

[73] Assignee: H. H. Robertson Company, Pittsburgh, Pa.

[21] Appl. No.: 932,334

[22] Filed: Aug. 9, 1978

[30] Foreign Application Priority Data

Aug. 27, 1977 [ES] Spain ..... 230.786[U]

[51] Int. Cl.[2] ..... E04D 3/362; E04D 3/38

[52] U.S. Cl. ..... 52/394; 52/528; 52/588; 52/595; 52/309.9

[58] Field of Search ..... 52/528, 394, 536, 539, 52/588, 595, 309.9, 309.1, 520, 478, 544

[56] References Cited

U.S. PATENT DOCUMENTS

| | | | |
|---|---|---|---|
| 1,558,410 | 10/1925 | Strong | 52/520 |
| 3,312,028 | 4/1967 | Schroyer | 52/588 X |
| 3,481,094 | 12/1969 | Taylor | 52/394 |
| 3,511,011 | 5/1970 | Straus | 52/478 |
| 3,559,359 | 2/1971 | Talbert | 52/394 |
| 3,777,430 | 12/1973 | Tischuk | 52/595 X |
| 4,034,532 | 7/1977 | Reinwall, Jr. | 52/544 X |
| 4,102,105 | 7/1978 | Taylor et al. | 52/528 X |
| 4,120,123 | 10/1978 | Knudson | 52/528 X |

FOREIGN PATENT DOCUMENTS

| | | | |
|---|---|---|---|
| 651724 | 9/1937 | Fed. Rep. of Germany | 52/528 |
| 1141071 | 12/1962 | Fed. Rep. of Germany | 52/528 |

*Primary Examiner*—Stephen J. Novosad

*Attorney, Agent, or Firm*—Harry B. Keck; George E. Manias

[57] ABSTRACT

A joint between roof panels of the type comprising inner and outer skins connected in shear-transferring relation by an insulating core. The joint comprises male and female marginal connecting means formed along the upper edges of adjacent side walls presented by the outer skins of adjacent panels. The male and female connecting means are inter-nested, the female connecting means is bent, that is, closed about the male connecting means thereby to provide a primary interlocking connection of the standing seam type. A sealant engaging the male and female connecting means provides a primary weathertight seal at the exposed surface of the roof structure. Complementary mating elements may be formed along adjacent inner edges of the adjacent composite panels to provide a second connection at the interior face of the roof structure.

6 Claims, 6 Drawing Figures

ROOF PANEL JOINT

BACKGROUND OF THE INVENTION

1. Field of the Invention

This invention concerns a joint between insulated panels of the type adapted to be assembled in side-by-side interlocked relation and secured to a building framework to provide a roof structure.

2. Description of the Prior Art

Insulated roof panels presenting interfitted connecting elements one or both of which are adapted to be deformed to provide a standing seam connection are known in the art. See for example U.S. Pat. No. 3,312,028 (SCHROYER) and French patent 70.24971 (GLAROS).

A sealing tape or mastic is applied to the interior surface of the SCHROYER female connector to provide a weathertight seal when the female connector is closed about the male connector. However, during introduction of the male connector the female connector undergoes outward splaying which may result in crumbling or other deterioration of the sealant or mastic, and hence deterioration of the weathertight seal.

The female connector or the female and male connectors of the GLAROS standing seam joint undergoes severe bending stresses during closure of the joint, resulting in deterioration of a decorative outer coating. The GLAROS standing seam connection has not been commercially successful.

SUMMARY OF THE INVENTION

The principal object of the invention is to provide an improved joint between male and female marginal connecting means of adjacent composite panels, wherein after the connecting means are internested, the female connecting means is bent about the male connecting means to provide a primary interlocking connection of the standing seam type therebetween for the purpose of preventing vertical disengagement of the male and female marginal connecting means under wind loading; and for the purpose of improving the watertightness of the roof structure.

Complementary mating elements formed along the adjacent inner edges of the adjacent composite panel provide a second connection between the interior faces of the composite panels to prevent differential vertical movement between one interior face relative to the other for the purpose of precluding degradation of the vapor barrier at the interior face of the roof structure.

The present invention is particularly useful in composite roof panels of the type comprising an inner skin, an outer skin, and an insulating core which connects the inner skin in shear-transferring relation to the outer skin.

The present improved joint is characterized in that the outer skins have upstanding first and second sidewalls formed along the adjacent longitudinal edge of the outer skins. A first connecting means in the form of a generally tubular rib is provided along the upper edge of the first sidewall. The tubular rib has a terminal edge spaced-apart from the upper edge of the first sidewall. Second marginal connecting means initially is in the form of an arcuate open loop formed along an upper edge of the second sidewall and adapted to nestingly receive the first tubular rib of an adjacent roof panel. The arcuate open loop is further adapted to be bent to form a second generally tubular rib which surrounds the first generally tubular rib and has an in-turned terminal portion extending around the terminal edge of and into the interior of the first tubular rib, thereby locking the second rib to the first rib.

The present joint is further characterized in that a tongue is formed along and extends laterally outwardly of the longitudinal edge of one inner skin and in that a complementary groove is formed along and extends laterally inwardly of the longitudinal edge of the adjacent inner skin. The tongue extends into the complementary groove thereby to provide a positive mechanical connection between the inner skins.

The present joint is further characterized in that a sealant disposed within the annular space between the first and second tubular ribs provides a weathertight seal at the exposed surface of the adjacent roof panels.

The joint is still further characterized in that a second sealant disposed within the complementary groove and which is penetrated by the tongue provides a second weathertight seal at the interior surface of the adjacent roof panels.

DESCRIPTION OF THE PREFERRED EMBODIMENTS

Figure 1:
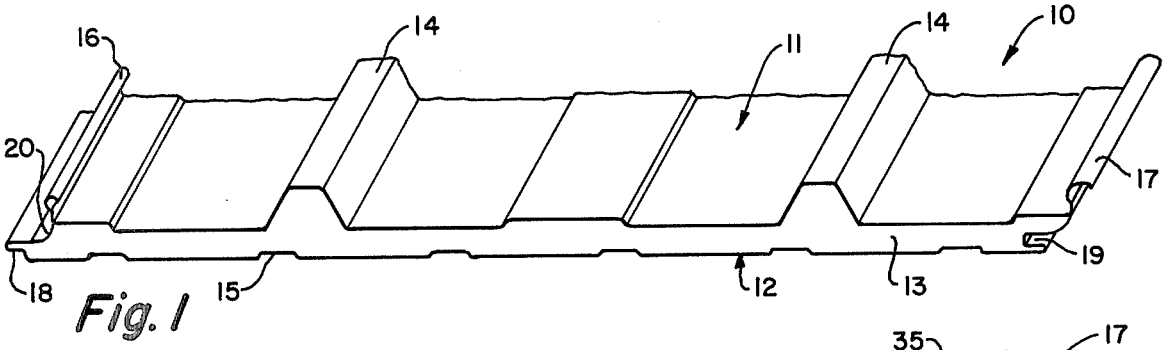
FIG. 1 is a fragmentary perspective view of an insulated roof panel provided with the marginal connecting means and the complementary mating elements of this invention.

FIG. 1 illustrates a composite roof panel 10 assembled from outer and inner skins 11, 12 and an insulating core 13 which connects the outer skin 11 in shear-transferring relation to the inner skin 12. The inner and outer skins 11, 12 may be formed from sheet metal having a nominal thickness of about 0.50 millimeter. The skins 11, 12 my have an embossed pattern and may have a decorative coating applied to the exterior surfaces thereof. The insulating core 13 may comprise any suitable insulating material. Preferably, the insulating core 13 comprises a foamed plastic material, such as polyurethane which is foamed-in-place between the skins 11, 12. To improve the span capabilities of the roof panel 10, the outer skin 11 may be provided with upstanding ribs 14. The remaining portions of the outer skin 11 may be profiled, as illustrated in FIG. 1. The inner skin 12 may be provided with spaced depressions 15. The profiling of the skins 11, 12 helps eliminate waviness thereby improving the appearance of the exposed surfaces thereof.

First and second marginal connecting means 16, 17 of this invention are provided along the opposite longitudinal edges of the outer skin 11. First and second mating elements 18, 19 of this invention are provided along the opposite longitudinal edges of the inner skin 12. The outer skin 11 is laterally offset from the inner skin 12 of improve the thermal efficiency of the joint. The insulating core 13 presents an exposed core surface 20 in the region between the first connecting means 16 and the first mating element 18. The panel 10 is thereby adapted to be secured to a structural support by fastening means which penetrates the exposed core surface 20 and which is hidden from view.

Figure 2:
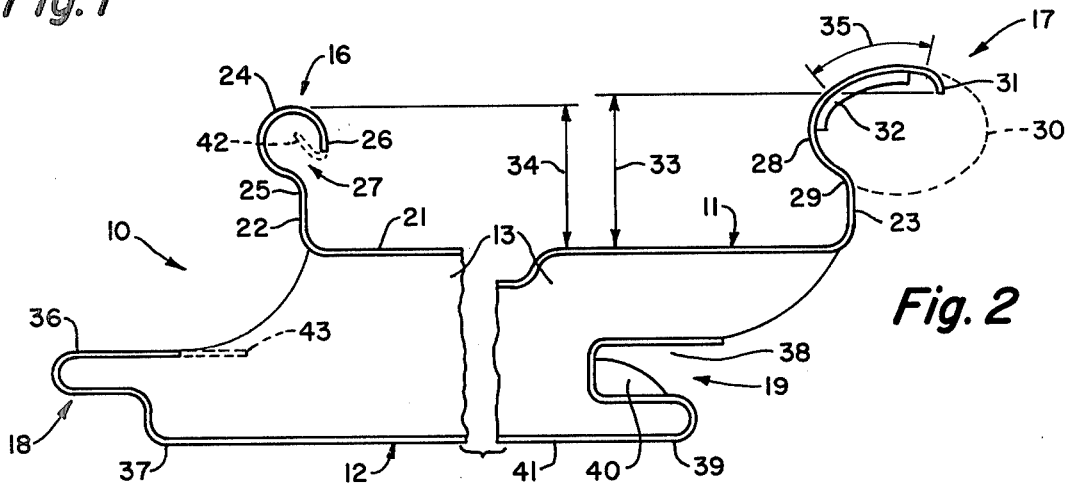
FIG. 2 is an end view of the roof panel of FIG. 1, illustrating the complementary mating elements and the marginal connecting means.

Referring to FIG. 2, the outer skin 11 includes a central outer web 21 having first and second upstanding sidewalls 22, 23 extending upwardly from the opposite longitudinal edges of the web 21. The first connecting means 16 comprises a generally tubular rib 24 formed along an upper edge 25 of the first sidewall 22. The tubular rib 24 comprises an incomplete circle and presents a terminal flange 26 which extends tangentially from the rib 24 downwardly toward the central outer web 21. A lengthwise opening 27 presented between the terminal flange 26 and the upper edge 25 provides communication to the interior of the rib 24.

The second connecting means 17 comprises an arcuate open loop 28 formed along an upper edge 29 of the second sidewall 23. The open loop 28 has an elliptical-like transverse profile—and ellipse being shown for the purpose of illustration in dotted outline at 30. The open loop 28 extends away from the central upper web 21 and includes an in-turned terminal strip 31 extending downwardly toward the plane of the outer web 21. A relatively wide strip 32 of suitable sealant material is applied to the interior surface of and along the entire length of open loop 28.

To facilitate forming the joint of this invention and to avoid unnecessary and undesirable upward flexing of the arcuate open loop 28, the in-turned terminal strip 31 is disposed at a level (height 33) above the level (height 34) of the tubular rib 24. Thus with reference to FIG. 3, the in-turned terminal strip 31B passes freely over the tubular rib 24A as the second roof panel 10B is moved toward the first roof panel 10A. Once the loop 28B and the rib 24A are interfitted as in FIG. 3, a suitable self-driven forming device which incorporates forming rolls is employed to bend and thereby close the loop 28B about the rib 24A to form, with the aid of the sealant 32B, a primary weathertight joint illustrated in FIG. 4. It will be observed in FIG. 4 that the in-turned terminal strip 31B extends around and engages the now-bent terminal flange 26A, and extends through the lengthwise opening 27A into the interior of the rib 24A. The now-closed loop 28B and the rib 24A are securely interlocked and preclude entrance of wind-driven rain or other liquids through the primary seal.

Figure 5:
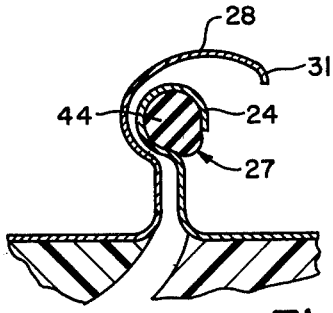
FIG. 5 is a fragmentary cross-sectional view, similar to FIG. 3, illustrating an alternative joint seal.
Figure 6:
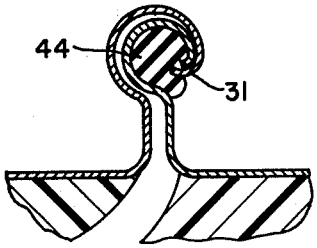
FIG. 6 is a fragmentary cross-sectional view, similar to FIG. 5, illustrating the completed joint.

The primary seal also may be formed as shown in FIGS. 5 and 6. A flexible sealing material 44, such as closed-cell polyurethane, completely fills the interior of the rib 24 and is exposed at the lengthwise opening 27. When loop 28 is closed, the in-turned terminal strip 31 penetrates the flexible sealing material 44, as shown in FIG. 6. If desired, the sealant strip 32 shown in FIG. 2 may be provided between the inner and outer ribs in addition to the flexible sealing material 44.

Figure 3:
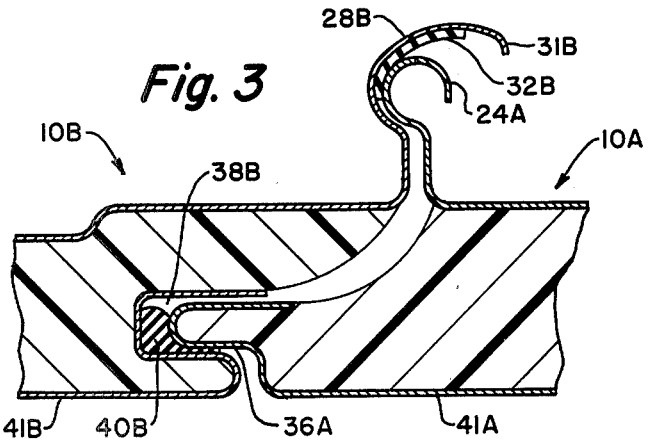
FIG. 3 is a fragmentary cross-sectional view, taken transversely through adjacent roof panels, illustrating the connecting means prior to being closed.
Figure 4:
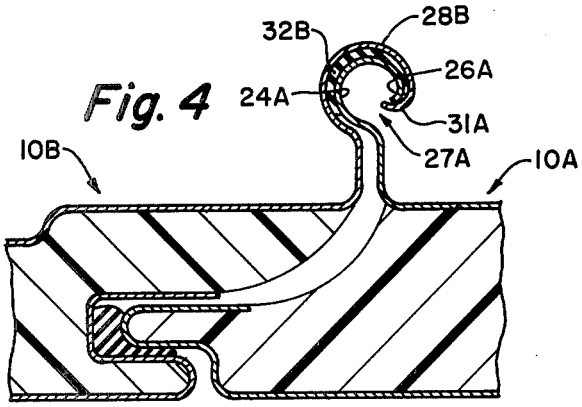
FIG. 4 is a fragmentary cross-sectional view similar to FIG. 3 illustrating the completed joint of this invention.

It will be appreciated from a comparison of FIGS. 3 and 4 that as the shape of the loop 28B is changed from generally elliptical to generally tubular, essentially only an arc segment identified at 35 in FIG. 2 undergoes bending. It will also be appreciated that the in-turned terminal strip 31B retains its original arcuate shape. Thus because of its initial elliptical shape the loop 28B experiences only minor bending stresses as it is closed about the rib 24A. Hence, a decorative coating which is applied to the exterior surface of the outer skin 11 will not experience undesirable cracking or spalling as the loop 28B is closed. Since only minor bending stresses are encountered, the number of different types of decorative coating materials which can be applied to the skin 11 is significantly increased.

Referring to FIG. 2, the first mating element 18 comprises a tongue 36 extending laterally outwardly of a longitudinal edge 37 of the central inner web 41. The second mating element 19 comprises a complementary groove 38 which extends laterally inwardly of the opposite longitudinal edge 39. The groove 38 is provided with a second sealant 40. The tongue 36 and the groove 38 extend generally parallel with the inner web 41 and reside between the plane of the outer web 21 and the plane of the inner web 41. When adjacent roof panels 10A, 10B are assembled in side-by-side relation as shown in FIG. 3, the tongue 36A enters the groove 38B and penetrates the sealant 40B thereby forming an efficient vapor barrier at the interior face of the joint. The central inner webs 41A, 41B of the adjacent panels 10A, 10B provide a flush interior surface.

The outer and inner skins 11, 12 are formed from material having a selected girth. When manufacturing the roof panel 10, the shape of the arcuate loop 28 and the shape of the complementary groove 38 are held to that illustrated in FIG. 2. Consequently, should the material girth exceed the selected girth, the excess or run-out material will appear, in the outer skin 11, as a flange illustrated in dotted outline at 42 which extends into the interior of the tubular rib 24; and will appear, in the inner skin 12, as an extension illustrated in dotted outline at 43 of the tongue 36. The flange 42 will not interfere with the connection forms between the loop 28 and the rib 24; and the extension 43 will not interfere with the connection formed between the tongue and a groove nor with the placement of the fastening means.

We claim:

1. A joint between adjacent roof panels of the type including spaced-apart outer and inner skins and an insulating core which secures the outer skin in shear-transferring relation to the inner skin, said joint comprising generally tubular inner and outer ribs presented along first and second upper edges of upstanding sidewalls which are formed along adjacent longitudinal edges of the outer skins, said inner rib comprising a segment of a cylinder and having a lengthwise opening between a terminal flange of said inner rib and the first upper edge of the sidewall, said outer rib having an inturned terminal strip which is engaged around said terminal edge and extends into the interior of said inner rib to securely lock said outer rib to said inner rib, said outer rib initially comprising an arcuate open loop having an elliptical transverse profile including said inturned terminal strip whereby said open loop experiences minimal bending stresses as it is bent about said inner rib to form said outer rib; and a sealant engaging the inner and outer ribs to provide a primary weathertight seal at the exposed surface of said adjacent roof panels.

2. The joint defined in claim 1 including interengaged complementary mating elements formed along the adjacent longitudinal edges of said inner skins to provide a positive mechanical connection between said inner skins.

3. The joint defined in claim 2 including a second sealant disposed between said interengaged complementary mating elements to provide an efficient vapor barrier at the interior surface of said adjacent roof panels.

4. The joint defined in claim 2 wherein said primary weathertight seal at the exposed surface of said adjacent roof panels is laterally offset from the joint formed between said interengaged complementary mating elements of said inner skins.

5. The joint defined in claim 1 wherein the first said sealant is compressed between the interior and exterior surfaces of the outer and inner ribs.

6. The joint defined in claim 1 wherein the first said sealant fills the interior of said inner rib and is exposed at said lengthwise opening, and wherein said in-turned terminal strip of said outer rib penetrates the first said sealant.

* * * * *